US008007140B2

(12) United States Patent
Zhang

(10) Patent No.: US 8,007,140 B2
(45) Date of Patent: Aug. 30, 2011

(54) LED MODULE

(75) Inventor: Hai-Wei Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 164 days.

(21) Appl. No.: 12/608,961

(22) Filed: Oct. 29, 2009

(65) Prior Publication Data

US 2011/0051427 A1 Mar. 3, 2011

(30) Foreign Application Priority Data

Sep. 3, 2009 (CN) ..... 2009 1 0306549

(51) Int. Cl.
*F21V 5/00* (2006.01)

(52) U.S. Cl. ..... 362/311.12; 362/311.06; 362/310; 362/296.05; 362/326; 362/335; 362/800

(58) Field of Classification Search ..... 362/800, 362/308–310, 296.05, 311.02, 311.06, 326, 362/335, 336

See application file for complete search history.

(56) References Cited

U.S. PATENT DOCUMENTS

| | | | | |
|---|---|---|---|---|
| 6,296,376 | B1 * | 10/2001 | Kondo et al. | 362/310 |
| 7,674,018 | B2 * | 3/2010 | Holder et al. | 362/311.06 |
| 7,841,750 | B2 * | 11/2010 | Wilcox et al. | 362/334 |
| 7,855,392 | B2 * | 12/2010 | Wu et al. | 257/98 |
| 2010/0328941 | A1 * | 12/2010 | Zhang et al. | 362/235 |
| 2011/0103070 | A1 * | 5/2011 | Zhang et al. | 362/311.02 |

* cited by examiner

*Primary Examiner* — Anabel Ton
(74) *Attorney, Agent, or Firm* — Altis Law Group, Inc.

(57) ABSTRACT

An LED module comprises an LED having an optical axis and a lens for refracting light from the LED. The lens is symmetric relative to a first plane at which the optical axis is located. The peak light intensity in the first plane occurs within 0-5 degrees off the optical axis. The light intensity in the first plane decreases from the peak light intensity with the increase of the angle off the optical axis. In a second plane perpendicularly intersected with the first plane at the optical axis, the peak light intensity occurs within 33-41 degrees off the optical axis, and the light intensity at the optical axis is larger than a half-peak light intensity. Within 0-33 degrees off the optical axis, the light intensity in the second plane increases with the increase of the angle off the optical axis.

12 Claims, 5 Drawing Sheets

LED MODULE

BACKGROUND

1. Technical Field

The disclosure relates generally to an LED (light emitting diode) module and, more particularly, to an LED module for lighting which has an improved lens.

2. Description of Related Art

LED street lamp, a solid-state lighting, utilizes LEDs as a source of illumination, providing advantages such as resistance to shock and nearly limitless lifetime under specific conditions. Thus, LED street lamps present a cost-effective yet high quality replacement for incandescent and fluorescent lamps.

A typical LED street lamp includes a housing and a plurality of LEDs mounted in the housing. When the LED street lamp is mounted at a side of a road, light emitted from the LEDs needs to be adjusted to illuminate a given location for satisfying the illumination demand of cars which are running on the road. A reflector is provided to adjust the light emitted from the LEDs. However, the reflector just adjusts the light having a larger angle off an optical axis of a corresponding LED, but it is difficult to adjust the light about the optical axis of the corresponding LED. Therefore, the LED street lamp utilizing the reflector cannot satisfy lighting of such a given location.

What is need therefore is an LED module having a design which can overcome the above limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

FIGS. 1 to 4 illustrate an LED (light emitting diode) module in accordance with an embodiment of the disclosure. The LED module comprises an LED 10 and a lens 20 covering the LED 10.

The lens 20 is integrally made of a transparent material with good optical performance, such as PMMA ((poly (methyl methacrylate)) or PC (polycarbonate). The lens 20 includes a substantially rectangular supporting base 22, a substantially rectangular connecting portion 24 extending upwardly from a top of the supporting base 22, and a light adjusting portion 26 protruding upwardly from a top of the connecting portion 24. The light adjusting portion 26 has an elongated configuration. The light adjusting portion 26 extends along elongated sides of the connecting portion 24 and deviates from a longitudinally middle line of the lens 20 to be close to one of the elongated sides of the connecting portion 24. The shape of the supporting base 22 can be changed according to actual needs. The connecting portion 24 is disposed at a center portion of the supporting base 22 and has a bottom area smaller than that of the supporting base 22. The light adjusting portion 26 has a bottom area smaller than that of the connecting portion 24.

Figure 1:
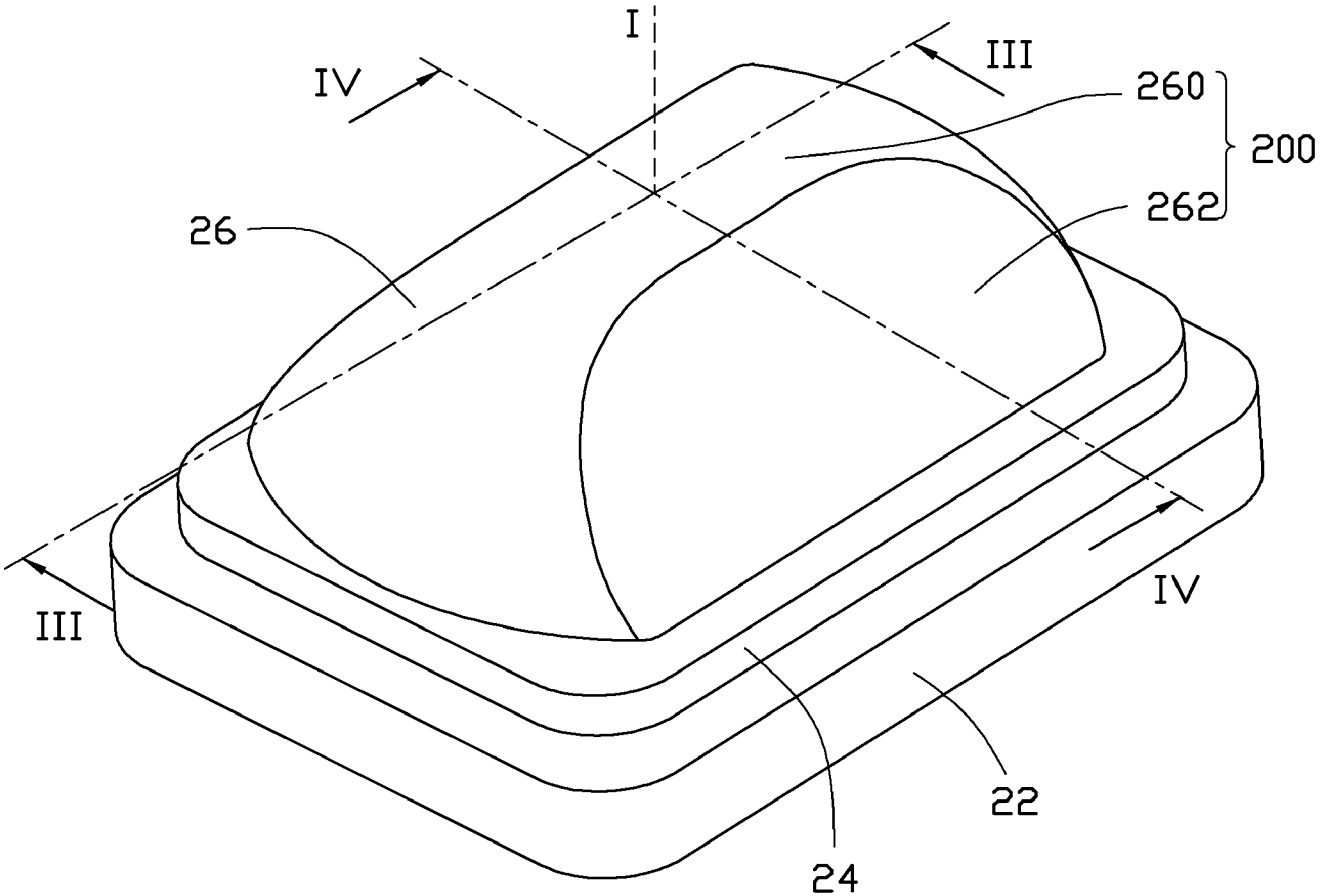
FIG. 1 is an isometric, assembled view of an LED module in accordance with an embodiment of the present disclosure.
Figure 2:
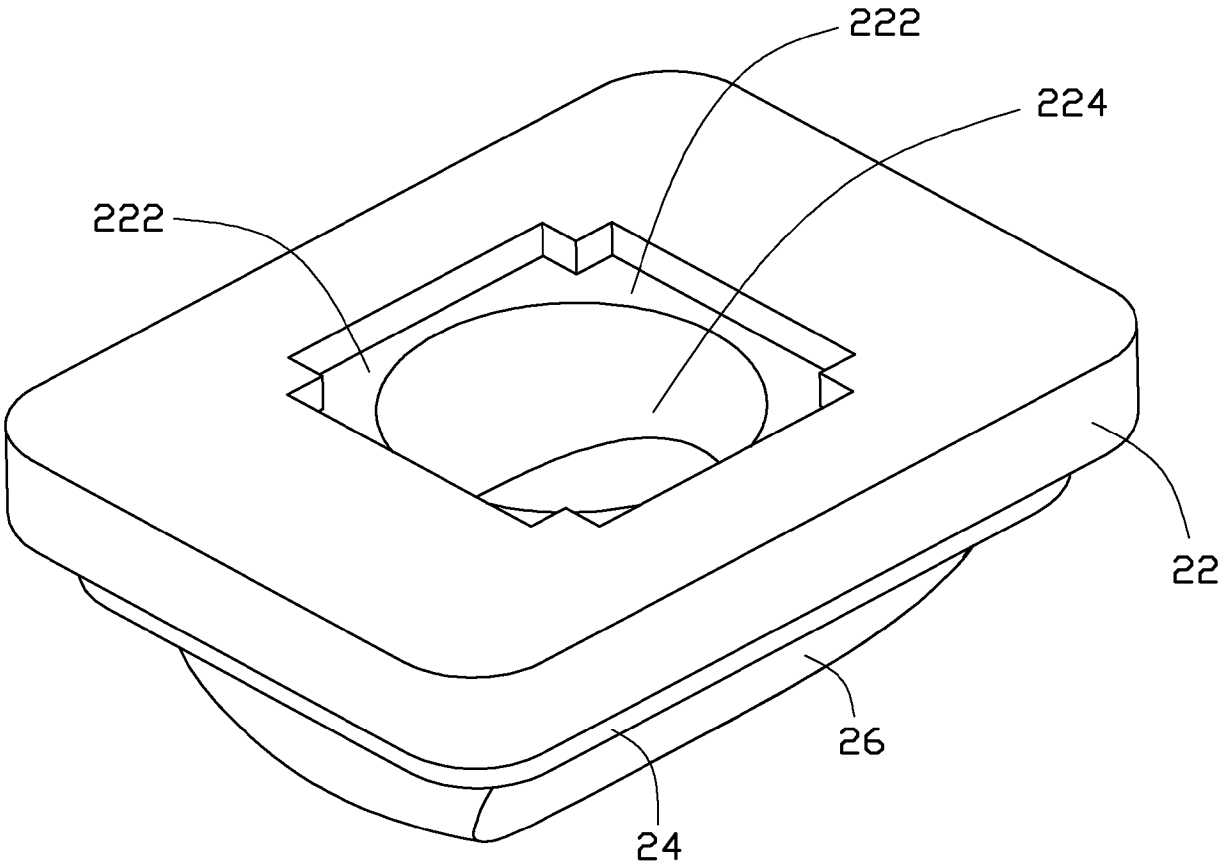
FIG. 2 is an inverted view of the LED module of FIG. 1, with an LED thereof being removed away.
Figure 3:
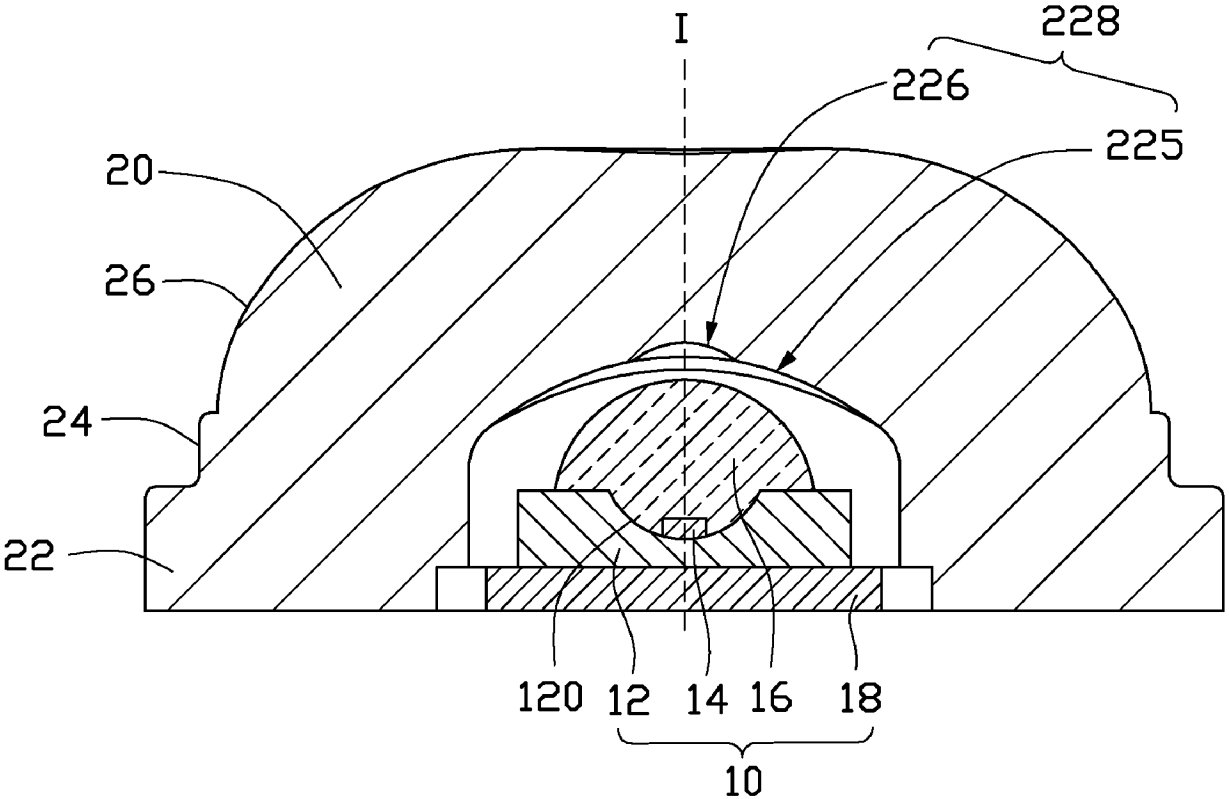
FIG. 3 is a cross-sectional view of the LED module of FIG. 1, taken along line III-III thereof.
Figure 4:
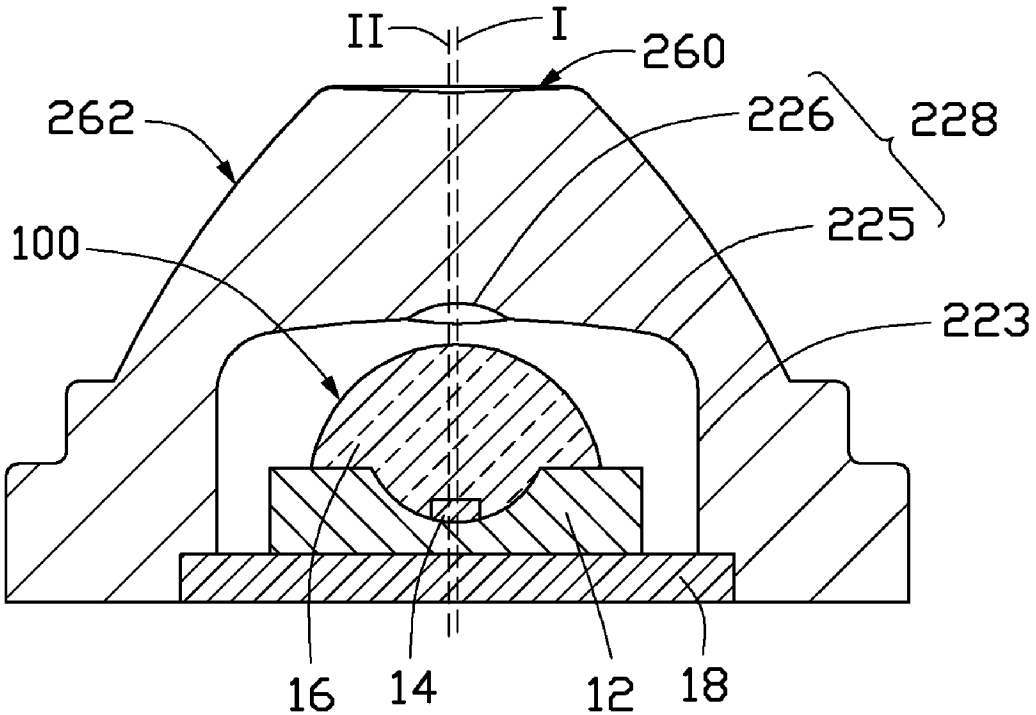
FIG. 4 is a cross-sectional view of the LED module of FIG. 1, taken along line IV-IV thereof.

The LED 10 has a vertical optical axis (marked as an optical axis I in FIGS. 1, 3 and 4). The lens 20 is symmetric relative to a first plane formed by the axis I and the line IV-IV of FIG. 1. The supporting portion 22 and the connecting portion 24 are symmetric relative to a second plane formed by the axis I and the line III-III of FIG. 1. The light adjusting portion 26 is not symmetric relative to the second plane since the light adjusting portion 26 is distant from one of the elongated sides of the connecting portion 24 and close to an opposite elongated side thereof. The first and second planes are perpendicularly intersected at the axis I. The lens 20 can be used in a lighting fixture to achieve a desired illumination for, such as, but not limited to a roadway, with the second plane aligned with the longitudinal direction of the roadway.

The light adjusting portion 26 has a convex top surface taken as an emission surface 200. The emission surface 200 includes a main surface 260 and two ellipsoid minor surfaces 262 located beside and connecting with the main surface 260. The emission surface 200 has an optical axis (marked as an optical axis II in FIG. 4) extending through a center of the main surface 260. The main surface 260 is progressively narrower upwardly from two opposite ends thereof to a middle thereof; that is, a width of the main surface 260 decreases from two ends to the middle thereof. The ellipsoid minor surfaces 262 are respectively located at two opposite sides of the main surface 260 and incline upwardly and inwards relative to the connecting portion 24. Widths of the ellipsoid minor surfaces 262 increase from two opposite ends to a middle thereof. The optical axis II of the emission surface 200 is parallel to and spaced from the optical axis I of the LED 10 a distance. The optical axis II is located at the first plane formed by the optical axis I and the line IV-IV of FIG. 1 and in the left of the optical axis I (see FIG. 4). The main surface 260 forms a downwards recessed spherical surface (not labeled) at a center portion thereof.

The lens 20 defines a positioning groove in a center of a bottom thereof. The positioning groove includes two crossed rectangular grooves 222. The grooves 222 are the same as and perpendicular to each other. A receiving groove 224 is defined upwardly in a center of a top of the positioning groove. An inner surface of the receiving groove 224 includes a cylinder surface 223 and a curved surface 225 covering a top of the cylinder surface 223. The curved surface 225 recesses upwardly to form a spherical surface 226 at a center thereof. The spherical surface 226 and the curved surface 225 each have an optical axis coincidental with the optical axis I of the LED 10.

The LED 10 includes a rectangular base 18, a cylinder substrate 12 mounted on a top of the base 18 and having a cavity 120 defined in a top thereof, an LED chip 14 received in the cavity 120 and an encapsulant 16 fixed on the top of the substrate 12 and filled in the cavity 120 for sealing the LED chip 14 in the cavity 120. Light emitted from the LED chip 14 is reflected upwardly by the top of the substrate 12 defining the cavity 120, thereby improving the light emitting efficiency of the LED 10. The encapsulant 16 has a semispherical surface at a top thereof, which is taken as an emission surface 100 of the LED 10. Light emerged out of the encapsulant 16 has a peak light intensity about the optical axis I. The number and power of the LED chip 14 can be changed corresponding to a desired lighting intensity.

Each of the grooves 222 of the lens 20 has an area identical to that of the base 18 of a corresponding LED 10, thereby receiving the base 18 in one of the grooves 222. The base 18 of the corresponding LED 10 may selectively be received in one of the grooves 222 according to the actual need, whereby the lens 20 may be positioned towards selected one of two perpendicular orientations for projecting the light emitted from the LED 10 towards the selected one of the two orientations. In the preferred embodiment, the base 18 is received in the groove 222 extended along the lengthwise direction of the lens 20. The substrate 12 and the encapsulant 16 are received in the receiving groove 224.

The curved surface 225 and the spherical surface 226, taken as a concaved incidence surface 228 of the lens 20, refract the light emerged out of emission surface 100 of the LED 10 into the lens 20. Most of the light emitted from the LED 10 is refracted by the emission surface 200 of the lens 20 towards a certain orientation since the optical axis II of the emission surface 200 is spaced from the optical axis I of the LED 10. Therefore, the lens 20 of the LED module can adjust the light emitted from the LED 10 to a desired light pattern.

Figure 5:
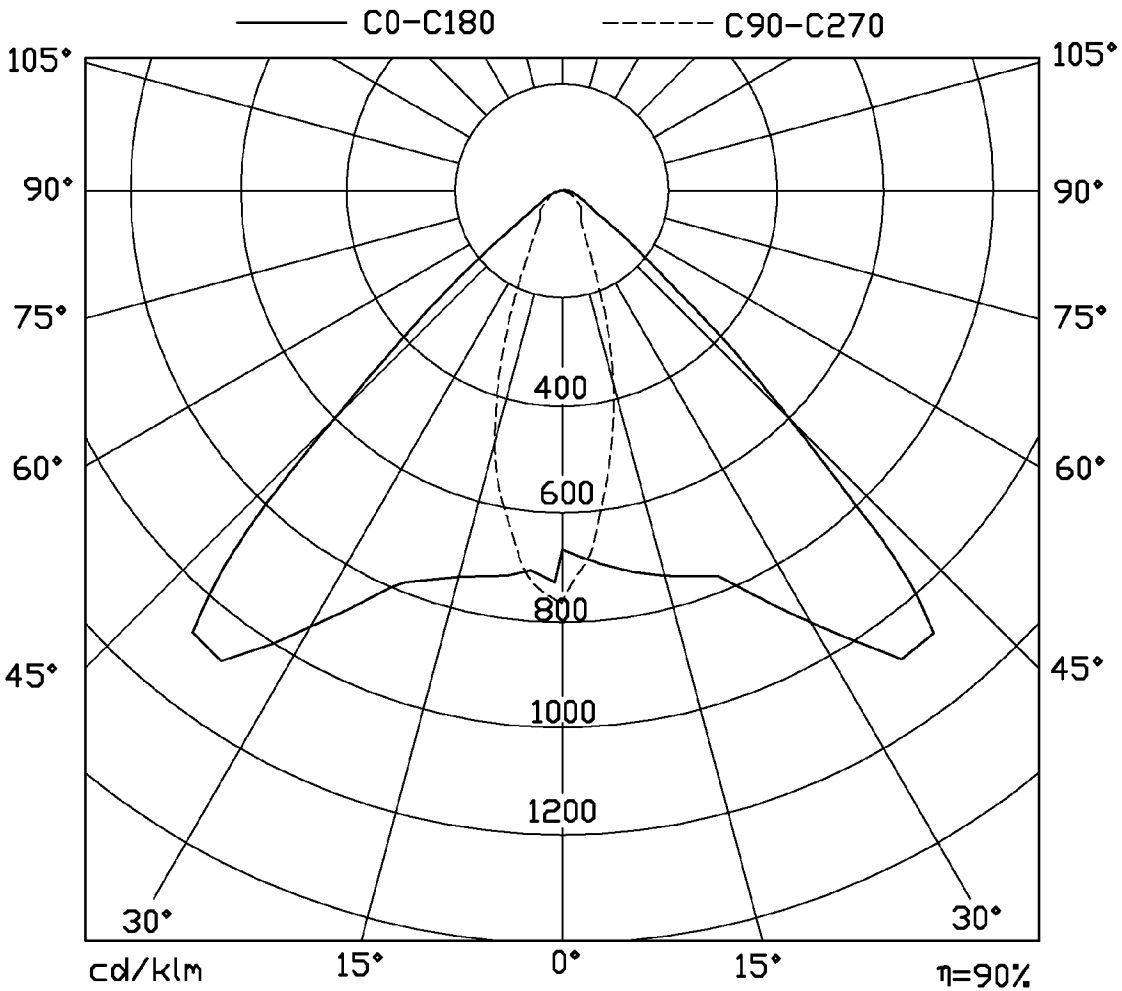
FIG. 5 is a graph of light intensity vs. angle for the LED module of FIG. 1.

FIG. 5 shows a dotted line and a solid line of the light intensity vs. angle in a polar coordinate for the LED module in the first plane and the second plane, respectively. In the first plane (referring to the dotted line), the light intensity sharply decreases with the increase of the angle off the optical axis I which is located at o degree. The peak light intensity for the LED module occurs within 0-5 degrees off the optical axis I. Half-peak light intensity for the LED module approximately occurs at 17 degrees leftwards off the optical axis I and at 14 degrees rightwards off the optical axis I, respectively. The zero light intensity in the first plane approximately occurs at 30 degrees leftwards off the optical axis I and at 20 degrees rightwards off the optical axis I, respectively.

In the second plane, the solid line shows the light intensity vs. angle in the polar coordinate for the LED module is generally symmetric relative to the optical axis I. The peak light intensity for the LED module occurs within 33-41 degrees off the optical axis I. A range within 35-40 degrees off the optical axis I is preferred. The half-peak light intensity for the LED module occurs within 45-47 degrees off the optical axis I. Within 0-33 degrees off the optical axis I, the light intensity gradually increases with the increase of the angle off the optical axis I, wherein the increased extent within 0-25 degrees is smaller than that within 25-33 degrees. When the angle off the optical axis I is larger than 42 degrees, the light intensity sharply decreases with the angle off the optical axis I. The zero light intensity approximately occurs at 60 degrees off the optical axis I As described above, since the half-peak intensity in the second plane occurs at a larger degree than that in the first plane, the illumination region along the second plane is larger than that along the first plane. Thus, a substantially rectangular light pattern is obtained, which is preferred to illuminate roadways, hallways, tunnels and so on, with more light in the longitudinally extending direction thereof, and less light in the transversely extending direction thereof, wherein, for example, a region neighboring the roadside of the roadways only needs little illumination.

The lens 20 of the LED module of this disclosure may replace the reflector of related art to adjust the light emitted from the LED 10. In order to obtain better light pattern, the reflector of related art and the lens 20 of this disclosure can be used together.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED (light emitting diode) module comprising:

an LED having an optical axis; and a lens fixed over the LED for refracting light emitted by the LED out of the LED module, the lens having a concaved incidence surface for the incidence of the light into the lens and an opposite convex emission surface for the emission of the light out of the lens;

wherein the lens is symmetric relative to a first plane on which the optical axis of the LED is located, a peak light intensity in the first plane occurring within 0-5 degrees off the optical axis of the LED, a light intensity in the first plane decreasing from the peak light intensity with the increase of the angle off the optical axis; and wherein a second plane is perpendicularly intersected with the first plane at the optical axis, a peak light intensity in the second plane occurring within 33-41 degrees off the optical axis, a light intensity in the second plane at the optical axis being larger than a half-peak light intensity in the second plane, the light intensity in the second plane increasing with the increase of the angle off the optical axis from 0 degree to 33 degrees.

2. The LED module as claimed in claim 1, wherein in the second plane, the light intensity within 41-60 degrees off the optical axis gradually decreases to zero.

3. The LED module as claimed in claim 1, wherein in the second plane, the increased extent of the light intensity within 0-25 degrees off the optical axis is smaller than that within 25-33 degrees off the optical axis.

4. The LED module as claimed in claim 1, wherein in the second plane, the light intensity at an angle rightwards off the optical axis is equal to that at a same angle leftwards off the optical axis.

5. The LED module as claimed in claim 1, wherein in the first plane, the light intensity at an angle rightwards off the optical axis is smaller than that at a same angle leftwards off the optical axis.

6. The LED module as claimed in claim 1, wherein in the first plane, a zero light intensity occurs at 30 degrees leftwards off the optical axis of the LED and at 20 degrees rightwards off the optical axis.

7. The LED module as claimed in claim 1, wherein the emission surface of the lens has another optical axis, the emission surface comprising a main surface extending longitudinally along the second plane and two ellipsoid minor surfaces connecting with the main surface, the incidence surface of the lens having a third optical axis, the incidence surface comprising a curved surface concaved upwardly toward the emission surface.

8. The LED module as claimed in claim 7, wherein the optical axis of the LED is coincidental with the third optical axis of the incidence surface, but offset from the another optical axis of the emission surface of the lens.

9. The LED module as claimed in claim 8, wherein the optical axis of the LED is parallel to and spaced from the another optical axis of the emission surface.

10. The LED module as claimed in claim 8, wherein the another optical axis of the emission surface is coplanar with the optical axis of the LED at the first plane and in the left of the optical axis of the LED.

11. The LED module as claimed in claim 7, wherein the main surface of the emission surface of the lens has a width decreasing from two opposite ends to a middle thereof, and widths of the ellipsoid minor surfaces increase from two opposite ends to a middle thereof.

12. The LED module as claimed in claim 7, wherein the incidence surface of the lens further comprises a spherical surface recessed upwardly from a center of the curved surface.

* * * * *